US006227367B1

(12) United States Patent
Harrelson et al.

(10) Patent No.: US 6,227,367 B1
(45) Date of Patent: May 8, 2001

(54) FULLY ENCLOSED CARTON WITH DIAMOND CORNER PANELS

(75) Inventors: Glen Ray Harrelson, Gainesville; Jim Fogle, Marietta, both of GA (US); Marty Jones, Graham, NC (US); Emili Requena Miret, Igualada (ES)

(73) Assignee: Riverwood International Corporation, Atlanta, GA (US)

( * ) Notice: Subject to any disclaimer, the term of this patent is extended or adjusted under 35 U.S.C. 154(b) by 0 days.

(21) Appl. No.: 09/591,212

(22) Filed: Jun. 9, 2000

(51) Int. Cl.[7] ..... B65D 75/00

(52) U.S. Cl. ..... 206/427; 206/141; 229/117.13

(58) Field of Search ..... 206/141, 162, 206/170, 174, 175, 193, 427–430, 431; 229/117.13, 117.12, 103.2

(56) References Cited

U.S. PATENT DOCUMENTS

| | | | | |
|---|---|---|---|---|
| 4,747,487 | * | 5/1988 | Wood | 206/427 |
| 5,197,598 | * | 3/1993 | Stout et al. | 206/141 |
| 5,246,112 | * | 9/1993 | Stout et al. | 206/427 |
| 5,704,470 | * | 1/1998 | Sutherland | 206/427 |
| 5,826,782 | * | 10/1998 | Stout | 206/427 |
| B1 6,170,741 | * | 1/2001 | Skolik et al. | 206/427 |

* cited by examiner

*Primary Examiner*—Luan K. Bul

(57) ABSTRACT

The present invention provides a fully enclosed wrap-around carton for bottles and cans that can be tightly packaged. The carton has triangular panels between the ends of the lower side panel and each lower end flap that diverge away from the bottom panel. There are a pair of triangular panels between the sloping upper side panel and each upper end flap that diverge away from the top panel. These triangular panels tighten the carton against bottles or cans packaged therein.

8 Claims, 2 Drawing Sheets

FULLY ENCLOSED CARTON WITH DIAMOND CORNER PANELS

BACKGROUND OF THE INVENTION

1. Field of the Invention

The present invention relates to a fully enclosed wrap-around carton for bottles and cans. It has a pair of triangular panels between the end of the lower side panel and each lower end flap that diverge away from the bottom panel. Similarly, there are a pair of triangular panels between the sloping upper side panel and each upper end flap that diverge away from the top panel. These triangular panels serve to tighten the carton against the bottles or cans packaged therein.

2. Background of the invention

U.S. Pat. No. 4,747,487 to Wood discloses a tubular carton, in which the lower part of each end is closed. A fold line is provided between each lower end panel and the side wall. A crease line is provided that extends divergently upward from the lower corner of each side wall and each end panel. Thus, the corner between the lower side panel and lower end panel is formed with a triangular panel, which is intermediate to the plane of the lower side wall and the lower end wall panel.

U.S. Pat. No. 5,197,598 to Stout et al. discloses a fully enclosed carton that is similar to the Wood carton except it also has triangular panels between the upper side wall and the upper end wall that diverges outwardly from the top panel to the lower side wall. This structure serves to keep the bottles taut in the carton. A carton with a similar set of triangular panels is disclosed in published European Patent Application No. 0 044 169.

It has been difficult to tighten fully enclosed wrap-around cartons around cans or bottles that are cylindrical in form because of the square corners of the carton. It would be desirable if a method could be found to tighten these cartons about the cans or bottles contained.

SUMMARY OF THE INVENTION

It is an object of this invention to find a method for tightening fully enclosed wrap-around cartons for containing cylindrical articles such as cans and bottles.

The object of this invention has been obtained with a fully enclosed wrap-around carton that has a pair of triangular panels between the sloping upper side panel and each upper end flap. These panels diverge away from the intersection between the top end flap, top panel and sloping upper side panel. A pair of triangular panels is provided between the lower side panel and each lower end flap that diverge away from the intersection between the bottom panel, bottom end flap, and lower side panel. When the carton is erected and loaded with the ends being glued, these triangular panels fold into separate planes that basically bisect each corner of the carton between the lower side panel and each lower end flap. These triangular panels are wider at the intersection between the lower side panel and the sloping upper side panel in order to accommodate the greater girth of the bottles at their midsection than at the neck.

These and other objects, features, and advantages of the present invention will become more apparent upon reading the following specification in conjunction with the accompanying drawing figures.

DETAILED DESCRIPTION OF THE PREFERRED EMBODIMENT

The present invention is intended primarily as a wrap-around carton for carrying a plurality of bottles or cans. This carton can be formed from a single piece of foldable material, such as a blank cut out of paperboard. The layout of the blank is basically rectangular, which results in economizing the amount of paperboard used.

Figure 1:
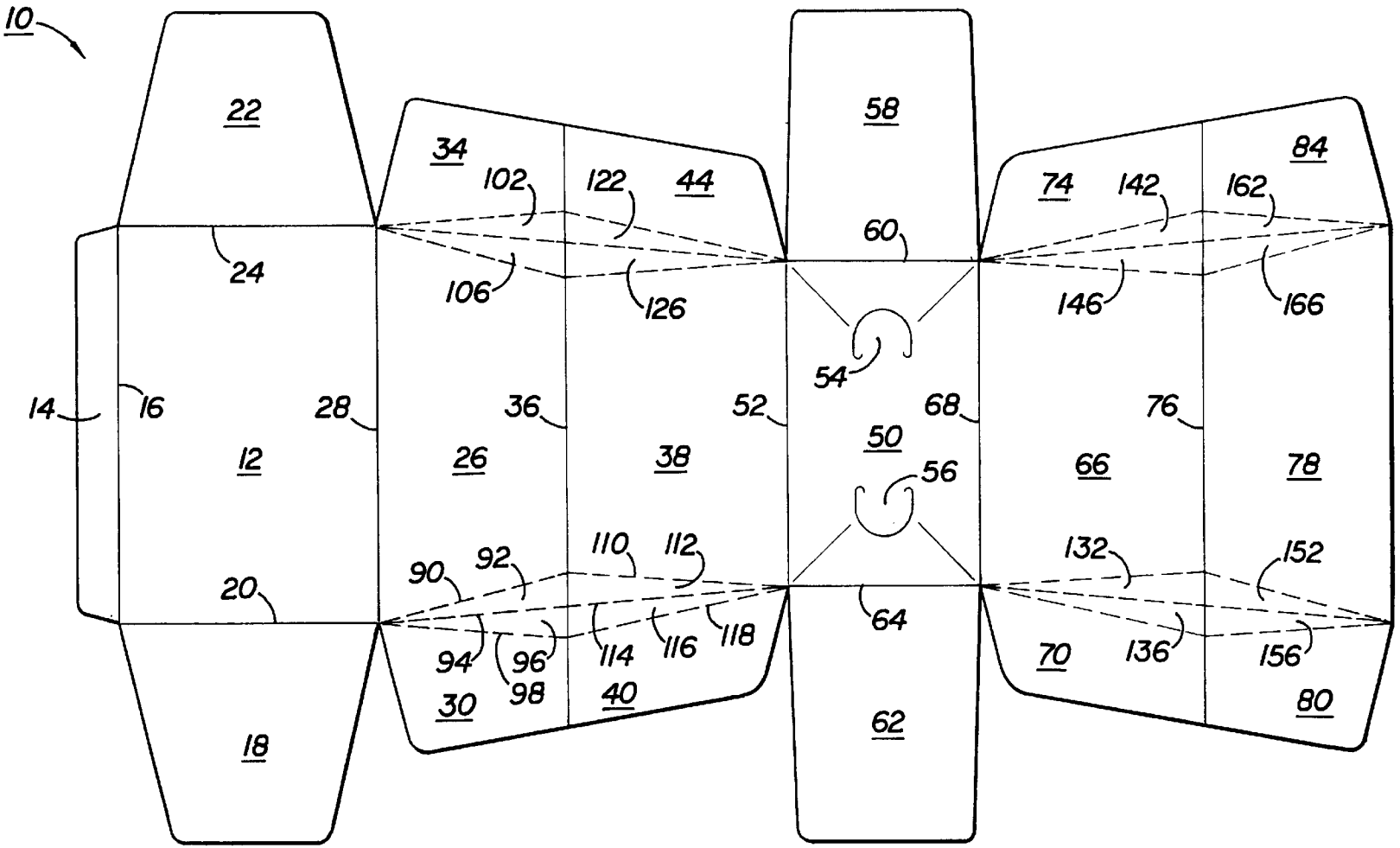
FIG. 1 is a plan view of a blank for forming a carton of this invention.

Referring to FIG. 1, the carton of this invention may be formed from a blank 10. The blank has an inner face (not shown) and an outer face as shown in FIG. 1., which may be coated for printing and display purposes. The carton has a bottom panel 12, which is attached to glue panel 14 by fold line 16. Bottom end flap 18 is attached to bottom panel 12 at one end by fold line 20 and bottom end flap 22 is attached to bottom panel 12 at its other end by fold line 24. The lower side panel 26 is attached to bottom panel 12 at one side by fold line 28. Lower side panel (bottom portion) 26 is foldably attached at one end by fold line 90 to triangular panel 92, which in turn is attached by fold line 94 to triangular panel 96, which in turn is foldably attached to lower end flap 30 by fold line 98. It will be noticed that the outside of all of these triangular panels is formed by lines 90 and 98, which diverge away from the corner formed by at the intersection of lower side panel 26, bottom panel 12 and bottom end flap 18. Lower side panel 26 is attached at its other end to lower end flap 34 by triangular panels 102 and 106.

Sloping upper side panel (upper portion) 38 is attached to lower side panel 26 by fold line 36. Sloping upper side panel 38 is connected at one end by fold line 110 to triangular panel 112, which in turn is connected by fold line 114 to triangular panel 116, which in turn is connected by fold line 118 to upper end flap 40. Triangular panels 112 and 116 diverge away from the intersection formed between sloping upper side panel 38 and top panel 50 and top end flap 62. It will be noticed that these triangular panels diverge in the opposite direction from the triangular panels between the lower side panel 26 and the lower end panel 30. Upper end flap 44 is attached to sloping upper side panel 38 by triangular panels 122 and 126.

Upper side panel 38 is attached to top panel 50 at one side by fold line 52. Top panel 50 has two finger apertures 54 and 56 for carrying the carton. Top panel 50 is attached at its ends to top end flaps 58 and 62 by fold lines 60 and 64, respectively. Top panel 50 is attached to sloping upper side panel 66 by fold line 68. Sloping upper side panel 66 is attached at its ends to upper end flaps 70 and 74 by triangular panels 132, 136, 142 and 146, respectively. Upper side panel 66 is attached to lower side panel 78 by fold line 76. Lower side panel 78 is attached at its ends to lower end flaps 80 and 84 by triangular panels 152, 156, 162 and 166, respectively.

Forming and Loading the Carton

Figure 2:
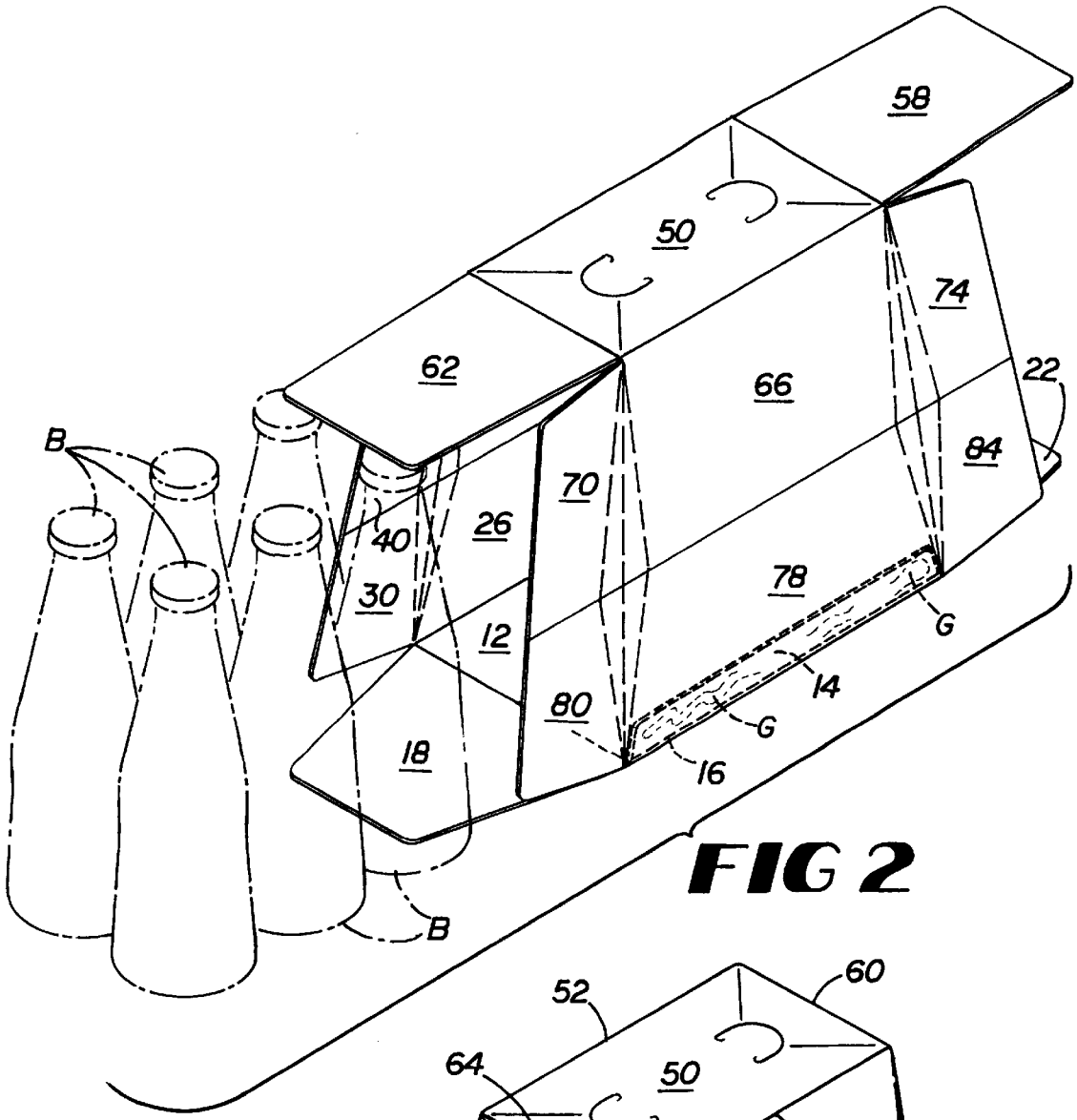
FIG. 2 is a perspective view of the carton with the end flaps open and a bottle group in phantom line exploded from one end of the carton.
Figure 3:
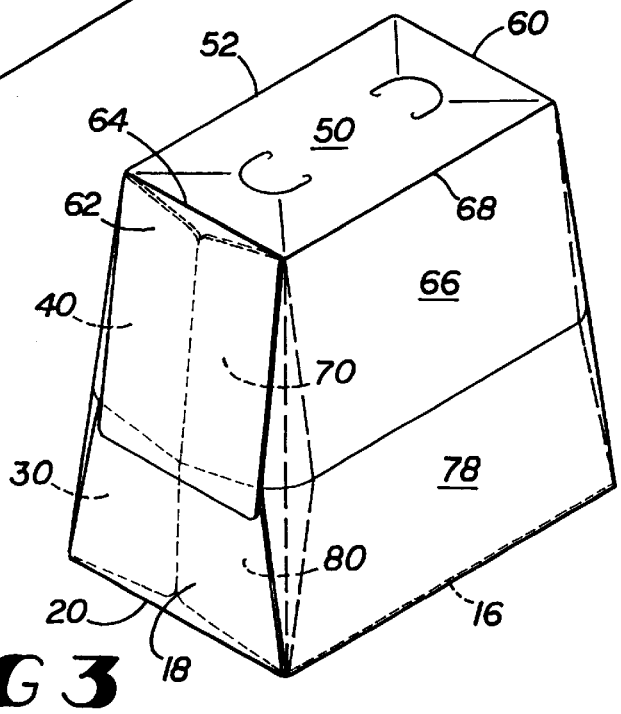
FIG. 3 is a perspective view of the finished carton with all flaps closed and glued and with the bottles secured therein.

A blank 10 can be formed into a sleeve for loading by gluing glue panel 14 to lower side panel 78 at a glue area G. The blank 10 can then be manipulated so that it forms a sleeve into which the bottles B may be slid by a packaging machine as illustrated in FIG. 2. This end of the carton may be closed by folding lower end flaps 30 and 80, and upper end flaps 40 and 70 inward. Top end flap 62 can be folded downward and bottom end flap 18 folded upwardly and glued to lower end flaps 30 and 80 and upper end flaps 40 and 70. The other end of the carton can be closed at the same time in order to form a tight package. This results in the carton illustrated in FIG. 3.

Unique Features of the Carton of This Invention

The carton of this invention lends itself for packaging bottles which have necks that are of a smaller diameter than the body of the bottle. Preferably, the carton of this invention, in order to package such bottles, has a top panel 50 where the distance between the ends (fold lines 60 and 64) is significantly less than the distance between the ends (fold lines 20, 24) of the bottom panel 12. In addition, the distance between the sides (fold lines 52 and 68) of the top panel 50 is significantly less than the distance between the sides (fold lines 16 and 28) of the bottom panel 12. This means that the sloping upper side panels 38 and 66 slope inwardly towards the top panel 50. Consequently, the bottles are packed more tightly in the carton, since the sides and ends slope inwardly towards the top panel 50.

The provision of triangular corner panels between the sloping upper side walls and the upper end flaps and also between the lower side panels and the lower end flaps provide greater contact with the bottle adjacent to each corner formed. This reduces the amount of void space in the corners, resulting in a tighter package. The triangular panels (e.g., triangular panels 112, 116) between the sloping upper side panels and upper end flaps diverge away from the intersection of top panel, sloping upper side panel and top end flap. The triangular panels need to be wider near the fold lines 36, 76 between the lower side panel 26, 78 and the sloping upper side panel 38, 66 in order to accommodate the greater diameter of the adjacent bottle at the midsection. The triangular panels can have a much narrower width near the top panel 50 where the neck of the bottle is located. The triangular panels (e.g., 92, 96) between the lower side panels and the lower end flaps diverge away from the intersection of bottom panel, lower side panel and bottom end flap, so that they meet the fold lines of triangular panels 112 and 116 between the upper sloping side panel and upper end flap at or near fold line 36. While the bottom of the bottle typically has the same diameter as the midsection, the reduced width of triangular panels 92 and 96 near the bottom panel results in holding the bottom of the bottles tightly with the bottom panel being larger than the top panel. The diamond like configuration of the combination of triangles (e.g., 92, 96, 112, and 116) permits the carton to be folded and closed without the bunching of paperboard, and ensures the tightening of the carton.

While the invention has been disclosed in its preferred forms, it will be apparent to those skilled in the art that many modifications, additions, and deletions can be made therein without departing from the spirit and scope of the invention and its equivalents as set forth in the following claims.

What is claimed is:

1. A fully enclosed wrap-around carton for containing a plurality of cylindrical articles comprising:

(a) a bottom panel with sides and ends, which is attached at each side to a lower side panel, which rises perpendicularly from the bottom panel and which has ends and an upper side which is attached to a sloping upper side panel with ends and a top edge which is attached to a top panel with ends and sides;

(b) a top end closure adjacent each end of the top panel formed by a top end flap foldably attached to an end of the top panel, an upper end flap which is foldably attached to the end of the sloping upper side panel via a pair of triangular panels that diverge away from the corner formed by the intersection of the top panel, sloping upper side panel, and top end flap, said flaps being secured together by securing means to form the closure; and (e) a bottom end closure adjacent each end of the bottom panel formed by a bottom end flap foldably attached to an end of the bottom panel, a lower end flap, which is foldably attached to the end of the lower side panel via a pair of triangular panels that diverge away from the corner formed by the intersection of the bottom panel, the lower side panel and bottom end flap, said flaps being secured together by securing means to form the closure.

2. The carton of claim 1, wherein the securing means is glue.

3. The carton of claim 1, wherein each lower end flap is foldably attached to the adjacent upper end flap.

4. The carton of claim 3, wherein the triangular panels connecting the upper end flap to the sloping upper side panel are foldably attached to the adjacent triangular panels which are foldably attached between the lower side panel and lower end flap.

5. The carton of claim 2, wherein the bottom panel is attached at one side to a glue panel, which is glued to a lower side panel.

6. The carton of claim 1, wherein the distance between the ends and sides of the top panel is significantly less than the distance between the sides and ends of the bottom panel.

7. A bottle carton comprising:

(a) top, bottom and side panels, each side panel having ends and a lower portion and an inwardly inclined upper portion, said top, bottom and side panels being interconnected to form a tubular structure, said top panel having ends and being rectangular, a top end flap foldably joined to each end of said top panel;

(b) said bottom panel having ends and being rectangular with a significantly larger dimension than said top panel, with end flaps being foldably joined to each end of each portion of each side panel, with a pair of triangular corner panels between each end flap and side panel with said triangular corner panels adjacent the upper portion of the side panel diverging away from the top panel and said triangular panel adjacent the bottom portion diverging away from the bottom panel so as to grip the bottles in a taut fashion; and (c) a bottom end panel attached to each end of the bottom panel and secured in overlapping relationship to the end flaps attached to the lower portion of the side panel, and said top end panel being secured in an overlapping relationship to the end flaps attached to the upper portion of the side panel.

8. The carton of claim 7, wherein the securing means is glue.

* * * * *